US006863262B2

(12) United States Patent
Brittain et al.

(10) Patent No.: US 6,863,262 B2
(45) Date of Patent: Mar. 8, 2005

(54) POLE BRIDLE

(75) Inventors: Carl C. Brittain, Dewey, AZ (US); John D. Mitchell, Scottsdale, AZ (US); Brian A. Booker, Glendale, AZ (US)

(73) Assignee: Pinnacle West Capital Corporation, Phoenix, AZ (US)

( * ) Notice: Subject to any disclaimer, the term of this patent is extended or adjusted under 35 U.S.C. 154(b) by 0 days.

(21) Appl. No.: 10/435,181

(22) Filed: May 9, 2003

(65) Prior Publication Data

US 2004/0222409 A1 Nov. 11, 2004

(51) Int. Cl.[7] ..... E21B 19/00
(52) U.S. Cl. ..... 254/30
(58) Field of Search ..... 294/74, 150, 113, 294/114, 115, 86.16, 86.42, 86.14, 104; 254/132, 131, 30, 31, 29 R, 133, 134; 269/43

(56) References Cited

U.S. PATENT DOCUMENTS

| | | | | |
|---|---|---|---|---|
| 261,629 A | * | 7/1882 | Raymond | 294/82.13 |
| 3,165,348 A | * | 1/1965 | Keskitalo | 294/106 |
| 3,704,503 A | * | 12/1972 | Haywood | 269/131 |
| 3,762,687 A | | 10/1973 | De Rome et al. | |
| 4,721,335 A | | 1/1988 | Krenek, Jr. | |
| 4,822,006 A | | 4/1989 | McIntire | |
| 6,382,594 B1 | | 5/2002 | Ransom | |

OTHER PUBLICATIONS

Fairmont Catalog, p. 33—Pole Puller.
Theirmann Industries, Inc.—Theirmann Industries Tiiger Pole Puller, Web Page. www.tiiger.com/polepullart.html, Mar. 26, 2003.
Koch "Latest Tools and Techniques Optimize Field Work" Electrical World T&D, Sept/Oct 2000, http://www.platts.com/engineering/issues/ElectricalWorld/0009/0009ew–tools.shtml.

* cited by examiner

*Primary Examiner*—Robert C. Watson
(74) *Attorney, Agent, or Firm*—Lowell W. Gresham; Jordan M. Meschkow; Meschkow & Gresham P.L.C.

(57) ABSTRACT

A pole bridle (20) for facilitating the manipulation of a pole (22) by a hoist includes plates (24) configured for placement in spaced-relation about the pole (22). Retaining members (26) are coupled to an outer surface (28) of the plates (24). The retaining members (26) are configured to retain a flexible member (62) of the hoist in encircling-relation about the pole (22). An upward force (72) imposed on the flexible member (62) creates a transverse force (74) on the plates (24) to direct the plates (24) against the pole (22). The transverse force (74) largely prevents the plates (24) from slipping along the pole (22) as the upward force (72) incrementally extracts the pole (22) from a fixed, upright position in the ground (60).

21 Claims, 3 Drawing Sheets

POLE BRIDLE

TECHNICAL FIELD OF THE INVENTION

The present invention relates to the field of utility pole maintenance. More specifically, the present invention relates to a pole bridle for use with a pole pulling mechanism that functions to extract poles from an embedded location in the earth.

BACKGROUND OF THE INVENTION

Large, elongate poles, often having a tapered shaft, are typically used as support structures for utility lines, billboards, large area lighting, antenna systems, and so forth. These poles sometimes need to be removed for any number of reasons. For example, when utilities are being placed underground or when an electrical line is being decommissioned, the poles are removed so that the land can be reclaimed for another purpose, such as for building roadways. The old poles may also be replaced when the poles have lost structural integrity.

When a pole, embedded in the earth and used as a support structure, needs to be removed, a pole puller is sometimes utilized. This device typically includes a hydraulic cylinder mounted to a base, with the cylinder aligned vertically adjacent the pole to be removed. The cylinder is affixed to the pole with a chain wrapped around the pole. Repeated actuations of the cylinder permit the pole to be extracted in small increments. Once the pole is extracted, the pole may be reused or discarded.

When used with a wooden pole, the links of the chain tend to bite into a wood to largely prevent the chain from rolling or slipping. Unfortunately, when such an apparatus is used to remove a steel pole, the chain cannot readily bite into the steel. Thus, the chain may slip, thereby making extraction of steel poles very difficult. If the chain is forced tight enough to bite into the steel, the hoop strength of the steel pole may be compromised. Hoop strength is a physical property that describes the ability of a tube, in this case the steel pole, to withstand internal pressure, bending force, and crushing force. Accordingly, if the hoop strength of the steel pole is compromised, the pole may be more likely to fail when a load is placed on the pole, leading to potentially costly equipment damage and significant safety issues.

Another problem with the use of pole pullers is that the chain must be loosened from the pole by a workman along with each downward (return) stroke of the cylinder. The workman must then work the chain down the pole prior to each upward stroke of the cylinder. Obviously, such activity increases the time required for pole extraction. Moreover, such activity is hazardous for the workman whose task it is to manipulate the chain. Indeed, fingers have been broken and even amputated due to the tension imposed on the chain by the pole puller.

For the reasons discussed above, the use of a pole puller with a chain has not previously been suitable for the removal of a steel pole. Therefore, excavation around the pole to the bottom, or butt, of the pole has been adopted as an alternative technique for pole removal. Once excavation is complete, the pole can then be pulled out with the boom on a boom truck. Unfortunately, such a technique is costly, due to the undesirably long time it takes to excavate and remove a single pole, due to the costly digging equipment needed to remove a steel pole, and due to the likelihood of damage to the pole by the excavating equipment. In addition, while this method may work satisfactorily in rural areas, it presents many problems and hazards if attempted in an urban setting, where underground utilities, pavement, etc., can limit its use. Also, after having extracted a pole by this means, it is thereafter difficult to insure that a new pole placed in the original hole will be firmly held in place, as the hole is, in effect, twice as big as was necessary.

Another method for removing old poles involves the use of a boom truck. The boom truck is backed up to the pole to be removed, and the boom is secured to the pole. By making repeated upward jerks with the boom, some poles, if not too tightly embedded, could be removed. However, this method is extremely disadvantageous in that it places severe stress on the most expensive equipment typically owned by utility or sign companies—the boom truck. In particular, with repeated use, the boom tends to bend or break at the interface between the boom and the truck bed. In addition, winch lines can snap, causing equipment damage and/or personnel injury.

Faced with these difficulties, some companies have chosen to cut off the pole and leave a "butt" in place, finding it to be less expensive to purchase a new pole rather than attempting to extract the old pole and reuse it. This is obviously a wasteful practice, since the pole cannot then be reused. In addition, environmental concerns arise when leaving a treated wooden pole "butt" in place. With regard to steel poles, companies and the general public may find it quite unacceptable to cut off a steel pole and leave the steel pole "butt" in place. As such, this practice is not a viable option if a reasonably practicable alternative is available.

Accordingly, what is needed is a mechanism for facilitating safe and economical removal of old poles, especially of steel poles.

SUMMARY OF THE INVENTION

Accordingly, it is an advantage of the present invention that a pole bridle is provided.

It is another advantage of the present invention that a pole bridle is provided that facilitates the safe extraction of a pole by a pole puller.

Another advantage of the present invention is that a pole bridle is provided that enables the use of a pole puller to remove steel poles.

Yet another advantage of the present invention is that a pole bridle for use with a pole puller is provided that is of simple construction, readily utilized, and mitigates the potential for damage to the pole during extraction.

The above and other advantages of the present invention are carried out in one form by a pole bridle for facilitating the manipulation of a pole by a hoist, the hoist including a flexible member. The pole bridle includes plates configured for placement in spaced-relation about the pole. Retaining members are coupled to an outer surface of the plates. The retaining members are configured to retain the flexible member in encircling-relation about the pole, wherein an upward force imposed on the flexible member creates a transverse force on the plates to direct the plates against the pole.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
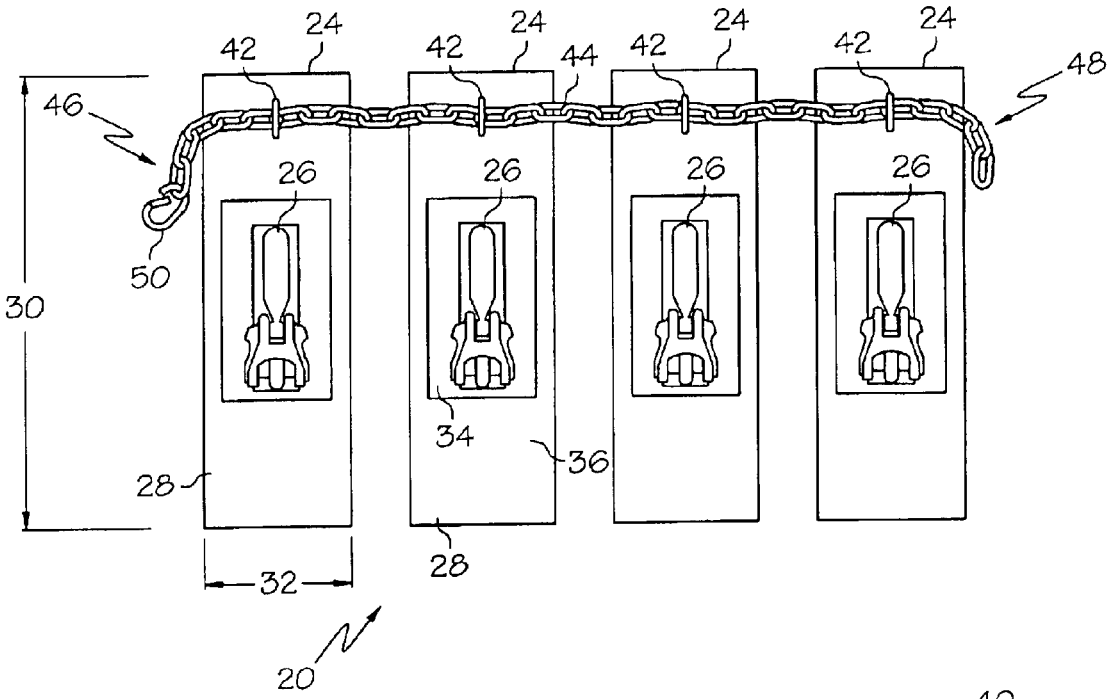
FIG. 1 shows a front view of a pole bridle in accordance with a preferred embodiment of the present invention.
Figure 2:
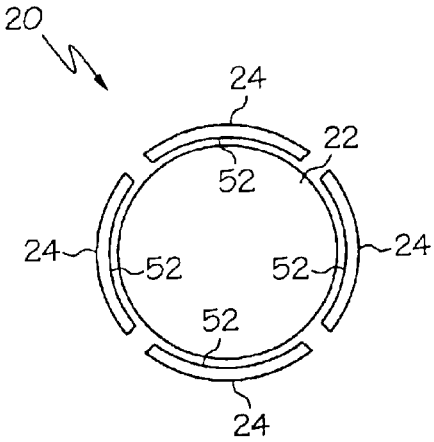
FIG. 2 shows a highly simplified top view of a circular pole showing a configuration of plates of the pole bridle of FIG. 1 encircling the pole.
Figure 3:
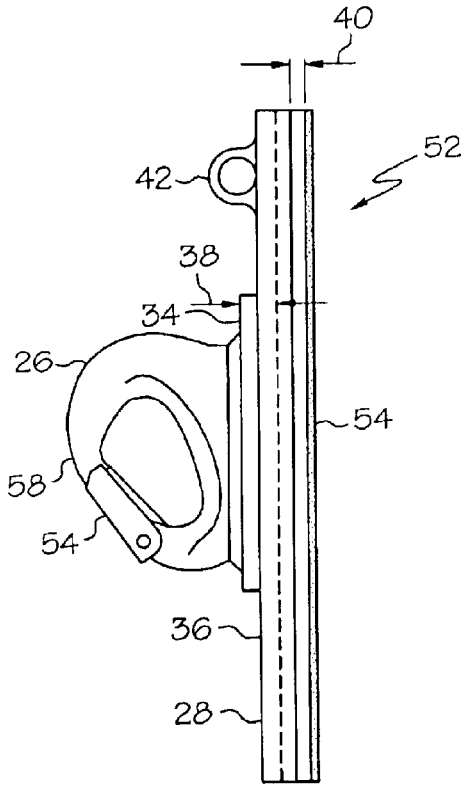
FIG. 3 shows a side view of one of a number of plates and retaining members of the pole bridle of FIG. 1.

Referring to FIGS. 1–3, FIG. 1 shows a front view of a pole bridle 20 in accordance with a preferred embodiment of the present invention. FIG. 2 shows a highly simplified top view of a circular pole 22 showing a configuration of plates 24 of pole bridle 20 encircling pole 22, and FIG. 3 shows a side view of one of a number of plates 24 and retaining members 26 of pole bridle 20. Pole 22 may be fabricated from any of a number of materials, such as wood, steel, concrete, fiberglass, and so forth. Pole bridle 20 functions to facilitate the extraction of pole 22 by a hoist mechanism, such as a conventional pole puller (not shown). In particular, pole bridle 20 enables the use of a conventional pole puller for removing steel poles.

One each of retaining members 26 is coupled to an outer surface 28 of one each of plates 24. Plates 24 are desirably manufactured from steel, and exhibit a rectangular shape having a length 30 that is greater than a width 32. For example, length 30 may be approximately eighteen inches and width 32 may be approximately five and one half inches. In addition, plates 24 are concave to accommodate the curvature of circular pole 22.

Each of plates 24 includes a first region 34 and a second region 36, first region 34 exhibits a first thickness 38 that is greater than a second thickness 40 of second region 36. For example, first thickness 38 of first region 34 may be approximately one inch, and second thickness 40 of second region 36 may be approximately three eighths of an inch. Retaining member 26 is coupled to plate 24 at first region 38. The additional thickness at first region 34 provides strength and rigidity to plates 24 for the attachment of retaining member 26, while the thinner dimension of plates 24 at second region 36 reduces the overall weight of plates 24. Those skilled in the art will recognize that plates 24 may also be fabricated having the same thickness throughout their lengths and widths. As shown, pole bridle 20 includes four plates 24. However, it will become apparent in the ensuing discussion, that pole bridle 20 may be adapted to include less than or more than four of plates 24.

Each of plates 24 also includes an eye 42 extending from outer surface 28. Linking means, in the form of a chain 44 is directed through each eye 42 of each of plates 24. Chain 44 includes a first end 46 and a second end 48. A connector 50 is secured to first end 46 and couples first end 46 to second end 48, as discussed below.

Plates 24 include an inner surface 52 on a side opposite outer surface 28 of each of plates 24. A slip-resistant material 54 may optionally be adhered to inner surface 52. In a preferred embodiment, slip-resistant material 54 is a spray- or brush-on coating such as, polyurethane, rubber, and the like. Slip-resistant material 54 forms a permanent bond with inner surface 52 and forms a non-skid, non-abrasive surface texture for protecting pole 22 from damage by plates 24.

In an exemplary embodiment, retaining members 26 are conventional weld-on lift hooks, such as those manufactured by the Crosby group, Inc., Tulsa, Oklahoma 74101. Retaining members 26 are bonded by welding to outer surface 28 of plates 24. Latch means, in the form of a heavy duty latch 54 interlocks with a hook tip 56 of each weld-on lift hook. Weld-on lift hooks are designed for attachment to mobile lifting equipment and typically have a working load limit of one to ten metric tons. Those skilled in the art will recognize that other retaining devices may be utilized in place of the weld-on lift hooks that are rated with high working load limits and have an opening through which a flexible member (discussed below) of a hoist mechanism, such as a pole puller (discussed below), may be directed. For example, a retaining device might be a weld-on or bolt-on ring or other such capturing member.

Figure 4:
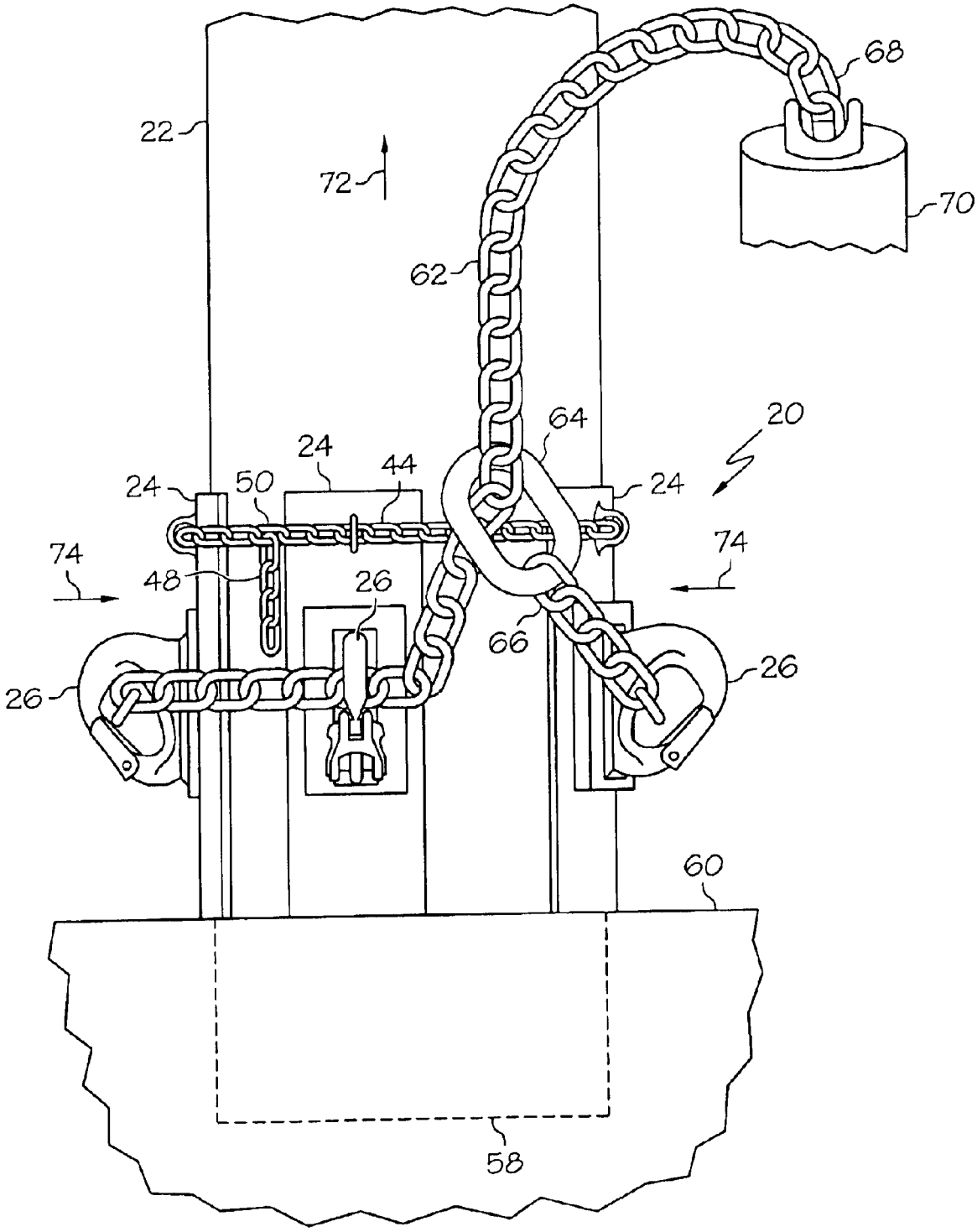
FIG. 4 shows a side view of the pole encircled by the pole bridle of FIG. 1.

FIG. 4 shows a side view of pole 22 encircled by pole bridle 20. As shown, a butt 58 of pole 22 is in a fixed, embedded upright position in the ground 60. In operation, an operator places pole bridle 20 about pole 22 with inner surface 52 (FIG. 2) facing pole 22, and length 30 (FIG. 1) of plates 24 axially aligned with pole 22. Plates 24 are spaced apart from one another about pole 22 at approximately equal distances. Connecter 50 is then coupled to second end 48 of chain 44 to loosely retain plates 24 about pole 22. As such, chain 44 temporarily holds pole bridle 20 in place about pole 22.

Once pole bridle 20 is loosely secured in place, a flexible member, in the form of a chain 62, is directed through retaining members 26. Chain 62 may be a high strength logging, or skidding, chain such as those utilized in connection with a conventional pole pullers. Alternatively, other approved flexible members may be employed, such as, a braided steel cable, a stranded steel cable, and so forth. Chain 62 is directed through each of retaining members 26 to encircle pole 22. An eye element 64 of chain 62 is then used to secure an end 66 of chain 62 to itself. More specifically, end 66 is coupled to eye element 64, and chain 62 is routed through a center opening 67 of eye element 64. As such, retaining members 26 retain chain 62 in an encircling-relation about pole 22.

A second end 68 of chain 62 is secured to a hoist mechanism 70. In a preferred embodiment, hoist mechanism 70 is a conventional pole puller, only a portion of which is shown for simplicity of illustration. Pole puller 70 desirably imparts a generally upward lift force to extract pole 22, while a boom (not shown) of a boom truck may be used to move pole 22 once it has been extracted. Pole pullers for large, elongate poles, typically used as support structures for utility lines, billboards, large area lighting, antenna systems, and so forth, are manufactured by, for example, Fairmont Hydraulics of Fairmont, Minnesota, and Thiermann Industries, Inc. of Cedarburg, Wis.

Once chain 62 is secure, a generally upward force, represented by an arrow 72, is imposed on chain 62. That is, pole puller 70 is actuated to begin the extraction of pole 22 from the ground 60. Upward force 72 imposed on chain 62 creates an inwardly directed transverse force, represented by an arrow 74, on plates 24. That is, as chain 62 is pulled upward, chain 62 held by retaining members 26 tightens about pole bridle 20, thus drawing plates 24 snuggly against pole 22.

The use of plates 24 between chain 62 and pole 22 prevents chain 62 from biting into and damaging pole 22. In addition, first thickness 38 (FIG. 3) at first region 34 (FIG. 3) of plates 24 serves to hold chain 62 away from pole 22, and limit damage by chain 62 to pole 22. The inward directed transverse force 74 is distributed across the surface area of inner surface 52 (FIG. 3) of each of plates 24. Moreover, as upward force 72 increases, so to does transverse force 74. This distributed transverse force 74 causes pole bridle 20 to grip pole 22 largely preventing plates 24 from slipping along pole 22. This distribution of transverse force 74 is particularly advantageous when pole 22 is fabricated from steel because the distribution of transverse force 74 about pole 22 prevents the tubular steel pole from collapsing during extraction.

When the cylinder (not shown) of pole puller 70 has reached its maximum upward stroke, thus extracting pole 22 by an increment of, for example, fifteen inches, pole puller 70 begins its downward (return) stroke. The downward stroke causes a release of upward force 72 on chain 62. This release of upward force 72 causes an associated release of transverse force 74. As such, pole bridle loosens and readily slides down pole 22 for repositioning prior to the next upward stroke of the pole puller. Accordingly, chain 62 need not be manipulated by a workman along with the downward stroke of the cylinder and prior to the next upward stroke. Thus, significant savings, in terms of time, equipment, and labor costs, is achieved through the use of pole bridle 20. Moreover, increased personnel safety is achieved because a workman does not undertake the hazardous activity of manipulating chain 62 in response to downward and upward strokes of the pole puller. Repeated actuations of the pole puller can then be efficiently and safely performed to extract pole 22. Once pole 22 is extracted, pole 22 may be reused elsewhere.

Figure 5:
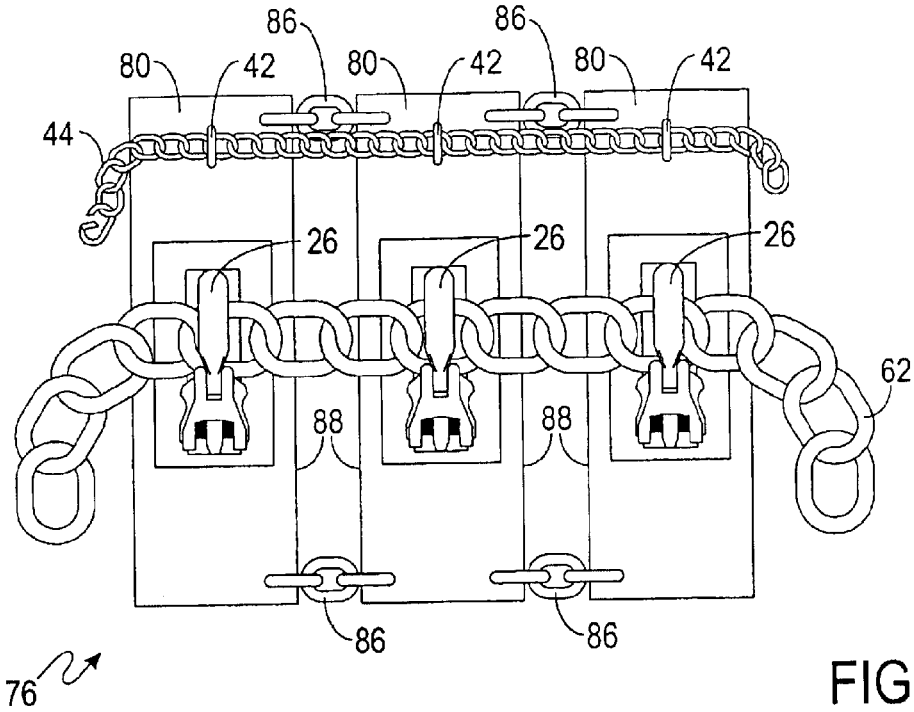
FIG. 5 shows a front view of a pole bridle in accordance with an alternative embodiment of the present invention.
Figure 6:
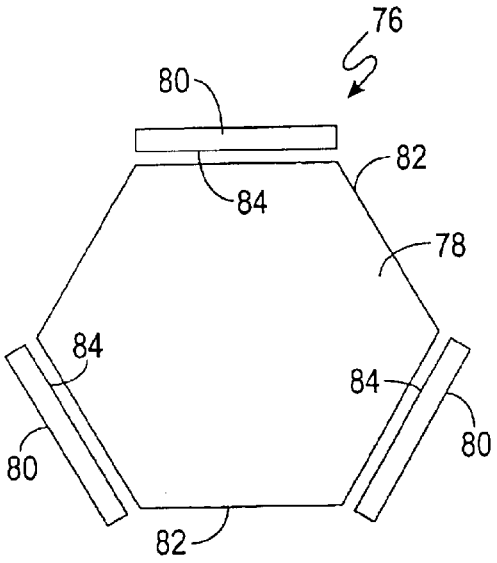
FIG. 6 shows a highly simplified top view of a hexagonal pole showing a configuration of plates of the pole bridle of FIG. 5.

Referring to FIGS. 5–6, FIG. 5 shows a front view of a pole bridle 76 in accordance with an alternative embodiment of the present invention. FIG. 6 shows a highly simplified top view of a hexagonal pole 78 showing a configuration of plates 80 of pole bridle 76. Pole bridle 76 is adapted to facilitate the extraction of pole 78 having flat sides 82. Pole 78 is shown as having only six sides for simplicity of illustration. Those skilled in the art will recognize that a flat sided pole may have more or less than eight sides. In addition, pole bridle 76 includes only three plates 80 for simplicity. Like pole bridle 20, pole bridle 76 may include more than three plates 80.

Retaining members 26 of pole bridle 76 are coupled to plates 80. Chain 62 of a hoist mechanism is shown directed through retaining members 26. Each of plates 80 also includes eyes 42 through which chain 44 is directed for loosely retaining pole bridle 76 about pole 22 (FIG. 4). Plates 80 exhibit a planar, or flat, shape, as opposed to the convex shape of plates 24 (FIG. 1) of pole bridle 20 (FIG. 1). Accordingly, a large surface area of an inner surface 84 of plates 80 will contact flat sides 82 of pole 78 when upward force 72 (FIG. 4) is imposed on chain 62.

Pole bridle 76 further includes linking means, in the form of chains 86 securing plates 80 to one another in aligned-relation. The "aligned-relation" refers to chains 86 securing each of plates 80 to one another along corresponding longitudinal edges 88, with the exception of one pair of plates 24. Chains 86 hold plates 80 of pole bridle 76 together for easier storage and handling when pole bridle 76 is not in use, and when pole bridle 76 is first placed on pole 78 prior to the interconnection of chain 44.

Chains 86 are shown as a fixed length of three links. However, chains 86 may be adjustable in length by adding a clasp and additional links to accommodate varying sizes of poles. Furthermore, plates 80 and chain 86 may be configured so that additional plates 80 may be attached. By way of example, a total of six plates 80 may be utilized so that plates 80 contact every flat side of pole 78. In another exemplary situation, additional plates 80 may be attached to accommodate a pole having more than six flat sides 82. In yet another example, multiple narrow, planar plates 80 may be used for gripping a circular pole, such as pole 22 (FIG. 4).

Figure 7:
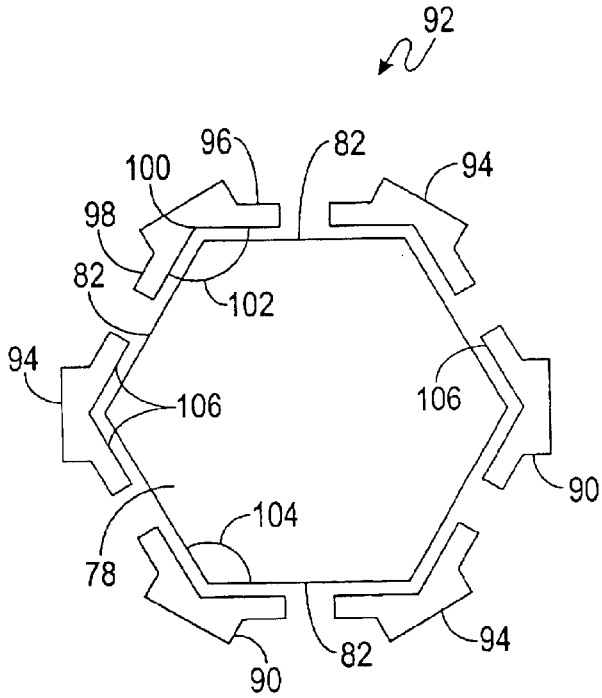
FIG. 7 shows a highly simplified top view of a hexagonal pole showing a configuration of angled plates of a pole bridle in accordance with another alternative embodiment of the present invention.

FIG. 7 shows a highly simplified top view of hexagonal pole 78 showing a configuration of angled plates 90 of a pole bridle 92 in accordance with another alternative embodiment of the present invention. Like pole bridle 76, pole bridle 92 is also adapted to facilitate the extraction of pole 78 having flat sides 82. Although not shown, retaining members 26 (FIG. 1) are coupled to an outer surface 94 of angled plates 90, and chain 62 (FIG. 4) of pole puller 70 (FIG. 4) is directed through retaining members 26.

Each of angled plates 90 includes a first leg 96 and a second leg 98 that join at a common edge 100. First and second legs 96 and 98, respectively, are configured for abutment against adjacent sides 82 of pole 78. As such, an angular separation 102 between first and second legs 96 and 98 corresponds with the shape of pole 78. For example, pole 78 is illustrated as a regular hexagon, thus each angle 104 of pole 78 is one hundred twenty degrees. Accordingly, for a regular hexagonal pole, angular separation 102 of angled plates 90 is approximately one hundred twenty degrees. Similarly, for a regular octagonal pole, angular separation 102 is approximately one hundred thirty five degrees.

First and second legs 96 and 98, respectively, each exhibit a planar, or flat, shape, as opposed to the convex shape of plates 24 (FIG. 1) of pole bridle 20 (FIG. 1). Accordingly, a large surface area of an inner surface 106 of angled plates 90 contacts adjacent flat sides 82 of pole 78 when upward force 72 (FIG. 4) is imposed on chain 62. The location of angled plates 90 over the corners of adjacent sides of pole 78, largely prevents chain 62 from coming into contact with and potentially damaging pole 78 as transverse force 74 (FIG. 4) causes angled plates 90 to be drawn snuggly against pole 78.

In summary, the present invention teaches of a simply constructed pole bridle that encircles a pole and facilitates the safe extraction of the pole using a pole puller. A transverse force applied to the plates of the pole bridle in response to an upward force causes the plates to securely grip the pole without damaging the pole. Moreover, since the transverse force is released when the upward force is released, a workman need not manipulate the chain of the pole puller in response to upward and downward strokes of the pole puller. Thus, significant savings is achieved in time, equipment, and labor costs associated with other pole pulling techniques, while increasing worker safety.

Although the preferred embodiments of the invention have been illustrated and described in detail, it will be readily apparent to those skilled in the art that various modifications may be made therein without departing from the spirit of the invention or from the scope of the appended claims. For example, the use of the pole bridle is described in connection with the extraction of poles from fixed, embedded upright positions. However, the present invention may also be used to manipulate poles when setting the poles.

What is claimed is:

1. A pole bridle for facilitating the manipulation of a pole by a hoist, said hoist including a flexible member, and said pole bridle comprising:

plates configured for placement in spaced-relation about said pole; and retaining members coupled to an outer surface of said plates, said retaining members being configured to retain said flexible member in encircling-relation about said pole, and said retaining members including means for translating an axial force to a transverse force, said transverse force directing said plates against said pole.

2. A pole bridle as claimed in claim 1 wherein said plates exhibit a convex shape.

3. A pole bridle as claimed in claim 1 wherein said plates exhibit a planar shape.

4. A pole bridle as claimed in claim 1 wherein each of said plates comprises:

a first leg; and a second leg adjoining said first leg at a common edge, said first and second legs being configured to abut adjacent sides of said pole.

5. A pole bridle as claimed in claim 1 wherein:

each of said plates includes an inner surface on a side opposite said outer surface; and said pole bridle further includes a slip-resistant material adhered to said inner surface of said each plate.

6. A pole bridle as claimed in claim 1 wherein:

each of said plates includes an eye;

said pole bridle further comprises linking means directed through said eye of said each plate; and a connector for coupling a first end of said linking means to a second end of said linking means for loose retention of said plates about said pole.

7. A pole bridle as claimed in claim 6 wherein said eye extends from said outer surface of said each plate.

8. A pole bridle as claimed in claim 1 wherein said retaining members are lift hooks.

9. A pole bridle as claimed in claim 8 wherein said lift hooks are weld-on hooks bonded to said outer surface of each of said plates.

10. A pole bridle as claimed in claim 1 wherein each of said retaining members includes latch means to prevent disengagement of said flexible member from said each retaining member.

11. A pole bridle as claimed in claim 1 wherein said each of said plates includes a first region and a second region, said first region exhibiting a first thickness that is greater than a second thickness of said second region, and one each of said retaining members is coupled to one each of said plates at said first region.

12. A pole bridle as claimed in claim 1 further comprising linking means coupling said plates together in aligned-relation.

13. A pole bridle as claimed in claim 1 wherein said each of said plates exhibits a rectangular shape having a length that is greater than a width, said length being configured for axial alignment with said pole.

14. A pole bridle for facilitating the extraction of a circular pole from a fixed, embedded upright position by a pole puller, said pole puller including a flexible member, and said pole bridle comprising:

convex plates configured for placement in spaced-relation about said circular pole, each of said convex plates including an eye;

linking means directed through said eye of said each convex plate;

a connector for coupling a first end of said linking means to a second end of said linking means for loose retention of said circular plates about said pole; and retaining members coupled to an outer surface of said plates, said retaining members being configured to retain said flexible member in encircling-relation about said circular pole, wherein an upward force imposed on said flexible member creates a transverse force on said plates to direct said plates against said pole.

15. A pole bridle as claimed in claim 14 wherein:

each of said plates includes an inner surface on a side opposite said outer surface; and said pole bridle further includes a slip-resistant material adhered to said inner surface of said each plate.

16. A pole bridle as claimed in claim 14 wherein said retaining members are lift hooks.

17. A pole bridle as claimed in claim 14 wherein each of said retaining members includes latch means to prevent disengagement of said flexible member from said each retaining member.

18. A pole bridle as claimed in claim 14 wherein said each of said concave plates exhibits a rectangular shape having a length that is greater than a width, said length being configured for axial alignment with said circular pole.

19. A pole bridle for facilitating the extraction of a pole from a fixed, embedded upright position by a pole puller, said pole puller including a flexible member, and said pole bridle comprising:

plates configured for placement in spaced-relation about said pole, each of said plates exhibiting a rectangular shape having a length that is greater than a width, said length being configured for axial alignment with said pole;

linking means coupling said plates together in aligned-relation; and lift hooks coupled to an outer surface of said plates, said lift hooks being configured to retain said flexible member in encircling-relation about said pole, and said lift hooks including means for translating an axial force to a transverse force, said transverse force directing said plates against said pole.

20. A pole bridle as claimed in claim 19 wherein said each of said plates includes a first region and a second region, said first region exhibiting a first thickness that is greater than a second thickness of said second region, and one each of said lift hooks is coupled to one each of said plates at said first region.

21. A pole bridle as claimed in claim 19 wherein:

each of said plates includes an eye;

said pole bridle further comprises second linking means directed through said eye of said each plate; and a connector for coupling a first end of said second linking means to a second end of said second linking means for loose retention of said plates about said pole.

* * * * *